United States Patent [19]

Napierski

[11] 4,065,888

[45] Jan. 3, 1978

[54] FLUID INFLATABLE SPATIALLY EXPANDABLE HOLLOW BODY CONSTRUCTION

[76] Inventor: Reinhard Hans Napierski, Hamburger Str. 1-3, Eschborn, Germany, 6236

[21] Appl. No.: 668,741

[22] Filed: Mar. 19, 1976

[51] Int. Cl.[2] ..... E04G 11/04

[52] U.S. Cl. ..... 52/2; 5/371; 135/1 R

[58] Field of Search ..... 52/2; 135/1 R, 20 B; 5/371; 137/625.19, 625.47

[56] References Cited

U.S. PATENT DOCUMENTS

| | | | |
|---|---|---|---|
| 2,297,150 | 9/1942 | Hunter | 135/DIG. 1 |
| 2,754,836 | 7/1956 | Darby | 52/2 |
| 2,785,695 | 3/1957 | Carey | 52/2 |
| 2,938,526 | 5/1960 | Harrison et al. | 52/2 |
| 2,946,337 | 7/1960 | Wolshin | 52/2 |
| 3,044,515 | 7/1962 | Eades | 52/2 X |
| 3,241,269 | 3/1966 | Reffell | 52/2 |
| 3,388,509 | 6/1968 | Mora | 52/2 |
| 3,710,791 | 1/1973 | Deaton | 52/2 X |
| 3,840,919 | 10/1974 | Middleton | 135/1 R X |
| 3,899,853 | 8/1975 | Wertman | 52/2 |

*Primary Examiner*—Thomas F. Callaghan
*Assistant Examiner*—Conrad L. Berman
*Attorney, Agent, or Firm*—Larson, Taylor and Hinds

[57] ABSTRACT

A spatially expandable hollow body construction is provided which is adapted to be filled by a fluid to provide expansion thereof. The construction includes a first fluid-inflatable hollow body including an outer skin, means for enabling automatic filling of the main hollow body by the sucking in of a fluid such as air when the skin of the main body is expanded and for preventing the escape of the fluid from the main body through the filling means, and a second, fluid inflatable hollow body connected to the first hollow body and arranged such that inflation of the second hollow body causes expansion of the skin of the first hollow body and consequent filling of the first hollow body by the sucking in of the ambient air. The filling means may comprise a simple non-return valve or a valve device which selectively provides shut-off of the inlet for the main body and the inlet for the second body.

7 Claims, 12 Drawing Figures

FLUID INFLATABLE SPATIALLY EXPANDABLE HOLLOW BODY CONSTRUCTION

The invention relates to a hollow body, to be enlarged spatially by filling with a fluid, as for example an air-mattress, a pneumatic boat, an air-bag, a balloon or a cylinder-piston-unit.

Normally, pumping up such objects is a rather lengthy and trying business, especially if there is no mechanical pressure fluid source at hand. In this regard, most of the time is needed just to enlarge the volume to the wanted extent, whereas afterwards providing the desired overpressure goes fast. The great effort in pumping up larger air-filled objects has means that this technique has mainly be limited to such applications where permanent pumping up and folding together was not necessary.

While normally for, inflatable objects, low weight and ready foldability are the most important attributes, in individual cases flexibility and variable shaping can also be advantageous. So for instance an automobile seat-back is known (See Swiss Patent No. 516 296), consisting of open porous foamplastic, on the outside covered with a tight case, which due to self-elasticity, and if need be by the aid of a spring, is biased to reach a certain cushion form with greatest possible volume. A form with smaller volume is set up by compressing the cushion, at which time the displaced air escapes through a line, with a valve, connected with the inside room of the cushion. By opening the valve, air is sucked in automatically, and in response to the admitted air volume the elastic cushion form can expand again.

Self-elasticity and inserted springs can be used only with smaller hollow bodies. It is disturbing and in the long run harmful for the elasticity, if for the folding together, the springs have to be tightened.

The invention is based on the problem of creating a hollow body of the mentioned kind, where the enlarging of volume is accelerated, and this problem is solved by connecting with the cover of the hollow body a second, closely associated hollow body and under pressure with fluid to be filled up, by which the cover of the first hollow body is capable of expanding.

The pumping up of the second hollow body, which serves as skeleton, is most simple and takes far less time than pumping up a large volume. By pumping up the hollow body skeleton, which can be an inside- or outside-skeleton, the object to be pumped up already is given its approximate form, and this happens by automatically sucking in of fluid, for instance air, with which the hollow body is to be filled. If no overpressure is necessary, at the end of the stretching process only the opening, through which the fluid was sucked in, needs to be closed tightly. If although, for instance, for stiffening the form of an object to be pumped up, at the end of the filling process an overpressure is desired, no trouble is required, in addition to the filling volume already sucked in, to pump in a comparatively small quantity of the fluid, as this fluid is no longer needed to enlarge the volume, but essentially serves only for increase of pressure.

The pumping process can be simplified, if the intake valve of the inflatable skeleton and the intake valve of the main chamber are joined, so that during pumping, the connection must not be changed. Conventional valves with one intake and two outlet passages can be used, which have four positions, i.e. a first, in which both outlet passages are opened, a second, in which the two outlet passages are closed, and a third and fourth, in which, respectively, one outlet passage is opened and the other closed.

The invention is mainly applicable for hollow bodies of a foldable, impervious material, but an application for cylinder-piston-units is also possible. In the latter case a cylinder-piston-unit with a comparatively small diameter serves to drive out another cylinder-piston-unit with a comparatively large diameter to a wanted length. At this the big cylinder fills automatically. At the end of this process, by pumping an additional small quantity of pressure fluid into the big cylinder, a desired overpressure can be produced.

The shaping of the skeleton naturally depends on the form of the object to be expanded or driven out. In general the skeleton can in connection with the main chamber of the object be an outside-skeleton of the shape of a surrounding hollow body or an inside-skeleton of the shape of ribs. Because, for other reasons, it is already known to make such hollow bodies double-walled, the practical construction provides no difficulties.

There are tents known, which by means of inflatable ribs or props are set up and kept up. The chambers of those props or ribs have a comparatively great volume. In a preferred application of the invention the hollow bodies, forming the skeleton of the object to be expanded — in this case the tent — are furnished again with their own foldable inside-skeleton, which helps to speed up the setting up of the tent.

In the following the invention is explained by diagrams.

FIG. 1 is a diagrammatic sketch of a tube-like hollow body with a double-skin, independent of the inflatable main chamber, FIGS. 2 to 5 illustrate various type models of hollow bodies with an inflatable inside-skeleton, FIGS. 6 to 9 illustrate, in accordance with the invention, various constructions of tent props, FIGS. 10 and 11 illustrate valve arrangements for hollow bodies with a skeleton to be put up by pumping up, FIG. 12 illustrates a cylinder-piston unit constructed in accordance with the invention.

The hollow body shown in profile in FIG. 1, for instance an inflatable tube, is distinguished from other, similar bodies by being furnished with an inflatable double-skin. The intake-pipes to the double-skin and to the inside of the tube are independent from each other and are denoted a and b respectively. The two skin-walls can be connected pointwise or in a lamellar manner.

If the illustrated tube or, for instance, a similar double-skin air mattress, shall be inflated, the hollow space in the double skin is first supplied with pressure. By this procedure, the tube (or the air mattress) gets its predetermined contour, i.e. the formerly folded material stetches and fills altogether with air through the opened intake *b*, without it being necessary to pump up the main chamber. After this setting up, the intake *a* of the hollow skin gets closed, and dependent if in the main chamber an overpressure is desired, the intake *b* to the main chamber gets also simply closed or the main chamber is additionally pumped up.

The constructions of FIG. 2 to 5 differ from that of FIG. 1 in principle only by using, instead of the illustrated skin formed outside-skeleton, various rib-like inside-skeletons. These can, as FIG. 4 illustrates, have at the front sides squared off ribs to increase the tension.

The skeleton of FIG. 5 consists of one single, several times squared off (bent) rib. As the broken line indicates, this can also be placed in a oblique manner.

FIG. 7 shows the plan view of a tent with six inflatable props. FIG. 6 shows a corresponding side-view of a prop. It is evident, that the props altogether are having a relative great volume, which to get pumped up makes trouble.

According to FIGS. 8 and 9, which illustrate different prop constructions in profile, are therefore in one case an outside skeleton and in the other case an inside-skeleton intended, whose volumes are so small, that they can get pumped up quickly, by which the props get set up and at the same time spontaneously fill with air.

Figure 1:
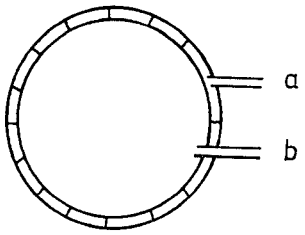
Figure 2:
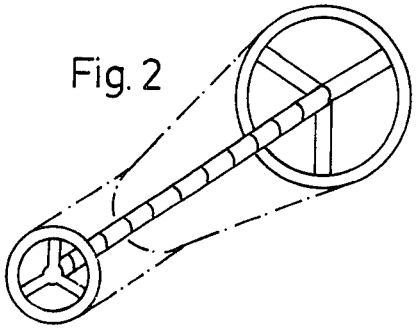
Figure 3:
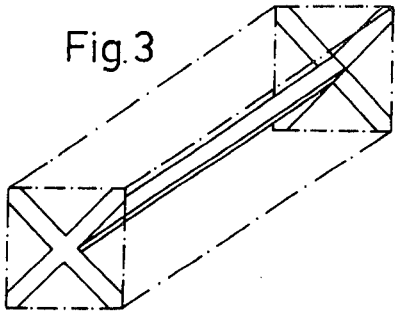
Figure 4:
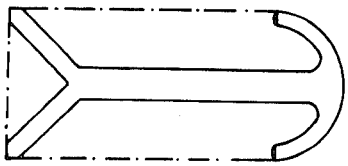
Figure 5:
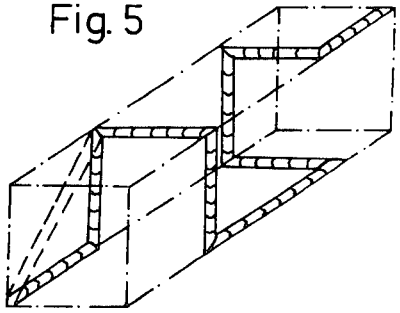
Figure 6:
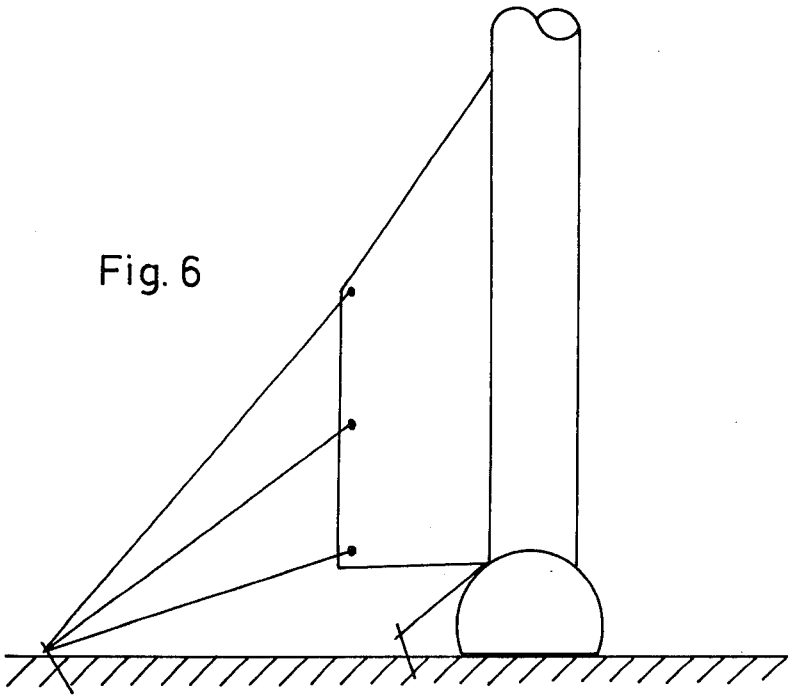
Figure 7:
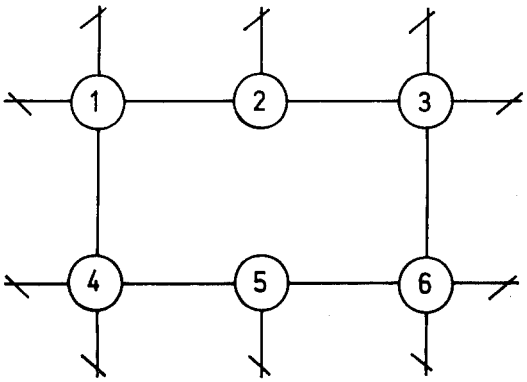
Figure 8:
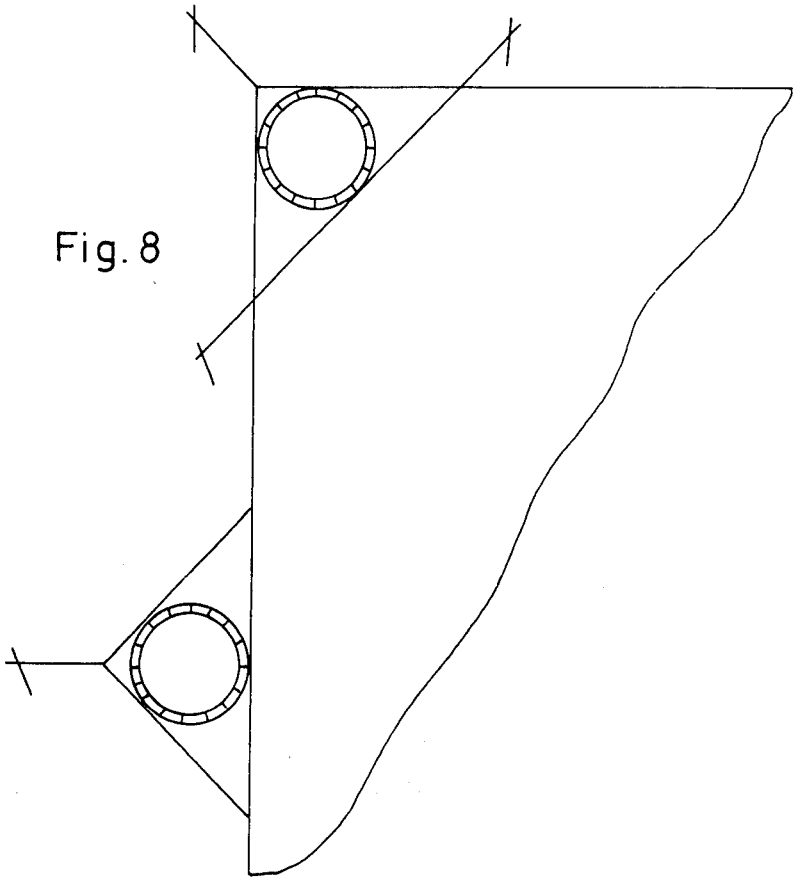
Figure 9:
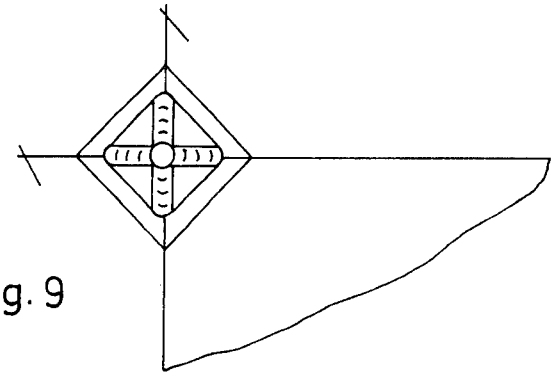
Figure 10:
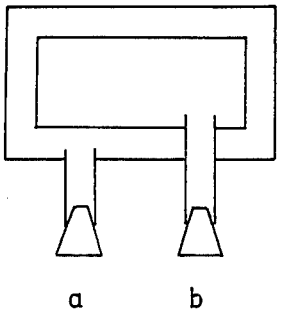
FIG. 10 illustrates a simple valve arrangement with two intake valves, operate independently from each other, for a hollow body with outside-skeleton in shape of a hollow skin. The valve of the hollow skin is marked with (a) and that of the main chamber of the hollow body with (b).
Figure 11:
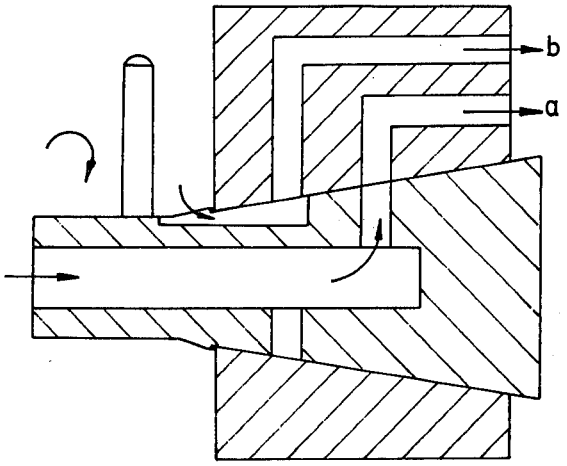
FIG.11 shows a combined valve with one single intake tube and two outlet passages, which, by choice, can individually or simultaneously be brought in connection with the intake tube or separated therefrom.
Figure 12:
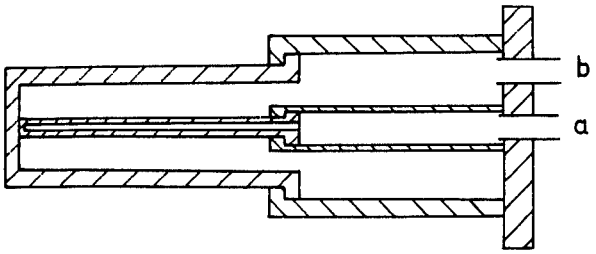

In FIG. 12 the application of the invention for a hydraulic or pneumatic pressure cylinder is shown. The latter is furnished with a much smaller diameter inner cylinder, which only serves to drive out or draw back very fast the piston of a big cylinder. In the predetermined position, a separate intake tube can be used to apply tp the big cylinder the desired pressure.

In all embodiments of the invention, can by appropriate control of the intake valve when inflating the skeleton, there can be produced an underpressure in the hollow body. In this manner it is possible to give, especially to a smooth, limp skin of the hollow body, a certain shape, which could never be achieved by free spontaneous sucking of air into the hollow body or by pressure loading. A hollow body of that kind can for instance serve as short time wall covering at a stage.

It is also contemplated that hollow bodies in accordance with the invention could be furnished with a nonreturn valve as intake valve and additionally with a relief valve jet. This valve combination is advantageous to avoid overpressure, for instance by warming in the sun or loading, which causes tearing or other damage. As far as the skeleton at the warming or loading keeps the tension constant, the hollow body can, even if a lot of air is lost, again and again form itself back into the extended state.

Another embodiment with valves has besides an intake-nonreturn-valve, a choker or choke valve. This combination can be used for instance for a spring mat or a spring board. At intermittent shock load, air is forced out of the hollow body through the choke valve, and is after that automatically sucked in through the intake valve, because the skeleton remains under tension.

What I claim is:

1. A spatially expandable hollow body construction adapted to be filled by a fluid to provide expansion thereof, said construction comprising a first fluid inflatable, main hollow body including an outer skin and means for enabling automatic filling of said first body by the sucking in of fluid when said skin of said first body is expanded and for preventing escape of said fluid from said main body through said filling means when the main body is expanded to the desired extent; and a second fluid inflatable hollow body connected to said first hollow body and arranged such that inflation of said second hollow body causes expansion of the skin of said first hollow body and consequent filling of said first hollow body by the sucking in of said fluid.

2. Hollow body construction according to claim 1, wherein the second hollow body comprises an outside-skeleton of the shape of a surrounding hollow body.

3. Hollow body construction according to claim 1, the second hollow body comprises at least one tube-like part, extending through an inner chamber defined by the first hollow body.

4. Hollow body construction according to claim 1, wherein at least one of the hollow bodies is a cylinder-piston-unit.

5. Hollow body construction according to claim 1 the second hollow body is subdivided in several individually with pressure loadable chambers.

6. Hollow body construction according to claim 1 wherein said filling means comprises a nonreturn valve, said first hollow body being additionally furnished with a relief valve jet.

7. Hollow body construction according to claim 1, wherein said filling means comprises a nonreturn valve, said first hollow body being furnished with a choker valve.

* * * * *